US005135116A

United States Patent [19]

Panzetti

[11] Patent Number: 5,135,116

[45] Date of Patent: Aug. 4, 1992

[54] PACKAGE CONTAINERS FOR LIQUID PRODUCTS

[76] Inventor: Franco Panzetti, Via Revere 10, 20123 Milano, Italy

[21] Appl. No.: 680,643

[22] Filed: Apr. 2, 1991

Related U.S. Application Data

[63] Continuation of Ser. No. 417,923, Oct. 6, 1989, abandoned.

[30] Foreign Application Priority Data

Oct. 7, 1988 [IT] Italy ..... 83670 A/88

[51] Int. Cl.[5] ..... B65D 1/04; B65D 23/12

[52] U.S. Cl. ..... 215/10; 206/504; 220/521

[58] Field of Search ..... 215/6, 10, 100 R, 227; 220/23.4, 23.83, 521; 206/504

[56] References Cited

U.S. PATENT DOCUMENTS

| | | | |
|---|---|---|---|
| D. 100,412 | 7/1936 | Carp | 215/6 X |
| D. 178,271 | 7/1956 | Bernard | D9/347 |
| D. 219,642 | 1/1971 | Prahs | D9/347 |
| 251,566 | 12/1881 | Fuller | 215/6 |
| 519,601 | 5/1894 | Dryfoos | 215/6 |
| 647,925 | 4/1900 | Kirby | 220/521 |
| 728,260 | 5/1903 | Maine | 220/521 |
| 876,427 | 1/1908 | Benson | 220/521 |
| 1,750,334 | 3/1930 | Stern | 220/521 X |
| 1,918,308 | 7/1933 | Webber | 215/6 |
| 2,019,565 | 11/1935 | Fulton et al. | 215/10 |
| 2,358,955 | 9/1944 | Weston | 220/521 X |
| 2,493,922 | 1/1950 | Miller | 215/6 |
| 2,629,508 | 2/1953 | Prager | 220/521 X |
| 2,684,167 | 7/1954 | Bruns | 215/6 |
| 2,744,649 | 5/1956 | Smith | 215/6 X |
| 2,780,225 | 2/1957 | Barr et al. | 215/6 X |
| 2,936,089 | 5/1960 | Goldfarb et al. | 215/6 |
| 3,039,601 | 6/1962 | Martin | 220/521 X |
| 3,079,022 | 2/1963 | Tompkins | 215/227 X |
| 3,095,109 | 6/1963 | Exton | 215/6 X |
| 3,262,596 | 7/1966 | Zillmann | 215/227 X |
| 3,269,389 | 8/1966 | Meurer et al. | 215/6 X |
| 3,581,927 | 6/1971 | Langdon | 220/521 X |
| 3,924,741 | 12/1975 | Kachur et al. | 215/6 X |
| 4,203,517 | 5/1980 | Hildebrandt et al. | 220/521 X |
| 4,235,343 | 11/1980 | Thompson | 215/10 X |
| 4,331,239 | 5/1982 | Ortal | 215/6 X |
| 4,640,423 | 2/1987 | Mednis | 206/504 X |
| 4,673,094 | 6/1987 | Mednis | 215/10 |
| 4,776,972 | 10/1988 | Barrett | 215/10 |
| 4,950,083 | 8/1990 | Bavaveas | 215/10 X |

FOREIGN PATENT DOCUMENTS

| | | | |
|---|---|---|---|
| 729092 | 12/1942 | Fed. Rep. of Germany | 215/6 |
| 1586701 | 7/1971 | Fed. Rep. of Germany | 215/10 |
| 2324844 | 12/1974 | Fed. Rep. of Germany | 215/100 R |
| 3032523 | 4/1982 | Fed. Rep. of Germany | 220/23.83 |
| 2299237 | 8/1976 | France | 215/10 |
| 477161 | 1/1953 | Italy | 215/6 |
| 34758 | 1/1935 | Netherlands | 215/6 |
| 1074558 | 7/1967 | United Kingdom | 215/10 |

*Primary Examiner*—Sue A. Weaver
*Attorney, Agent, or Firm*—Gifford, Groh, Sprinkle, Patmore and Anderson

[57] ABSTRACT

A package container for liquid products. The package includes a larger container and a smaller container. The smaller container is insertable into a recess formed within the larger container, permitting the larger and smaller containers to be joined together. The smaller container may also be shaped so as to insert within the cap of the larger container. The containers may further be packaged by placing the smaller container within a shell defined on a face of the larger container.

2 Claims, 3 Drawing Sheets

PACKAGE CONTAINERS FOR LIQUID PRODUCTS

This is a continuation of copending application Ser. No. 07/417,923 filed on Oct. 6, 1989, now abandoned.

BACKGROUND OF THE INVENTION

I. Field of the Invention

The present invention relates generally to package containers for liquid products and, more specifically, to package containers which are releasably connected to one another.

II. Description of the Prior Art

Package containers for various liquid products, such as perfumes, liquid cosmetics, and liquors are known in the art. Gift packages consisting of the above-mentioned products are also known which included more than one container of product sold as a single package.

The shortcomings of the above liquid products include the cumbersome manner in which a plurality of containers are packaged for sale and the unattractiveness of the packaging.

SUMMARY OF THE INVENTION

The present invention provides combination liquid containers which overcome the shortcomings of the prior art. In brief, the package container of the present invention comprises respective larger and smaller bottles or containers of liquid product. A recess is formed in one side of the larger container, and matches the general outline of the smaller container. In this manner, the smaller container may be releasably attached to the side of the larger container. A self-fastening coupling is created between the recess and the smaller bottle to maintain the larger and smaller bottles in locking contact. An alternate embodiment of the present invention includes the smaller container being configured to coaxially insert within the cap portion of the larger bottle. A still further embodiment permits the smaller container to be inserted within a shell defined on a side of the larger container.

BRIEF DESCRIPTION OF THE DRAWINGS

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2:
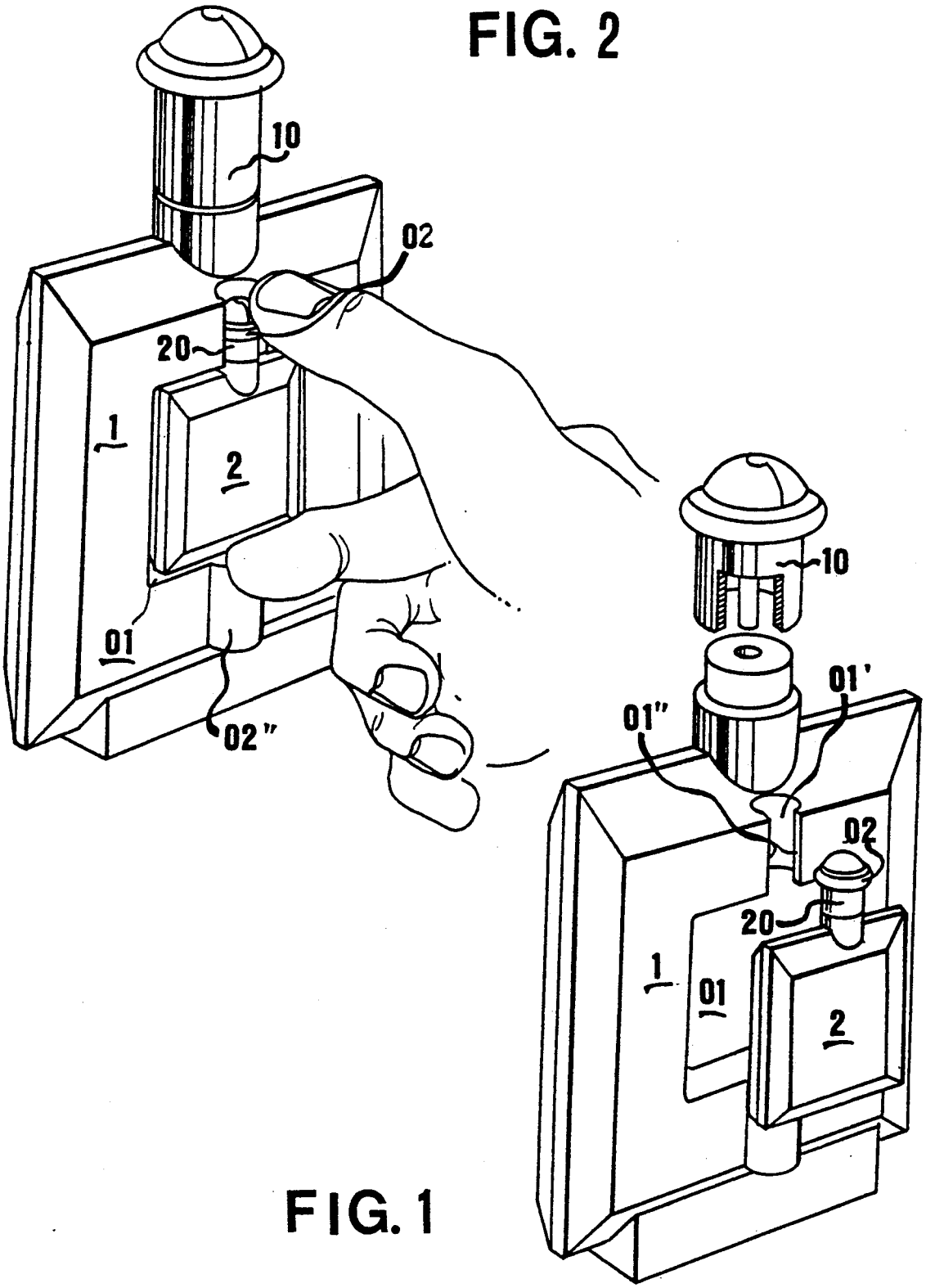
FIG. 1 is an exploded view of the larger and smaller containers of the present invention.
FIG. 2 is a perspective view of the combination containers of the present invention in locking engagement.

With reference to FIGS. 1 and 2, a preferred embodiment of the package container of the present invention is shown and comprises the combination of a larger container 1 and smaller container 2. The larger container 1 is preferably constructed of a substantially rigid material. Both containers 1 and 2 are further provided with appropriate caps, respectively, 10 and 20. A hollowed recess 01 is formed along a face of the larger container 1. The recess 01 is of a shape which matches the outline of smaller container 2, thus allowing container 2 to insert within larger container 1. The cap 20 of smaller container 2 further provides a deformable portion 02 which engages container 2 to the recess 01 of container 1. A self-fastening coupling is created by the locking engagment of the portion 02 with hollowed recess 01. Side finger passages 02" are further provided to facilitate detachment of the smaller container 2 from the larger container 1.

Figure 3:
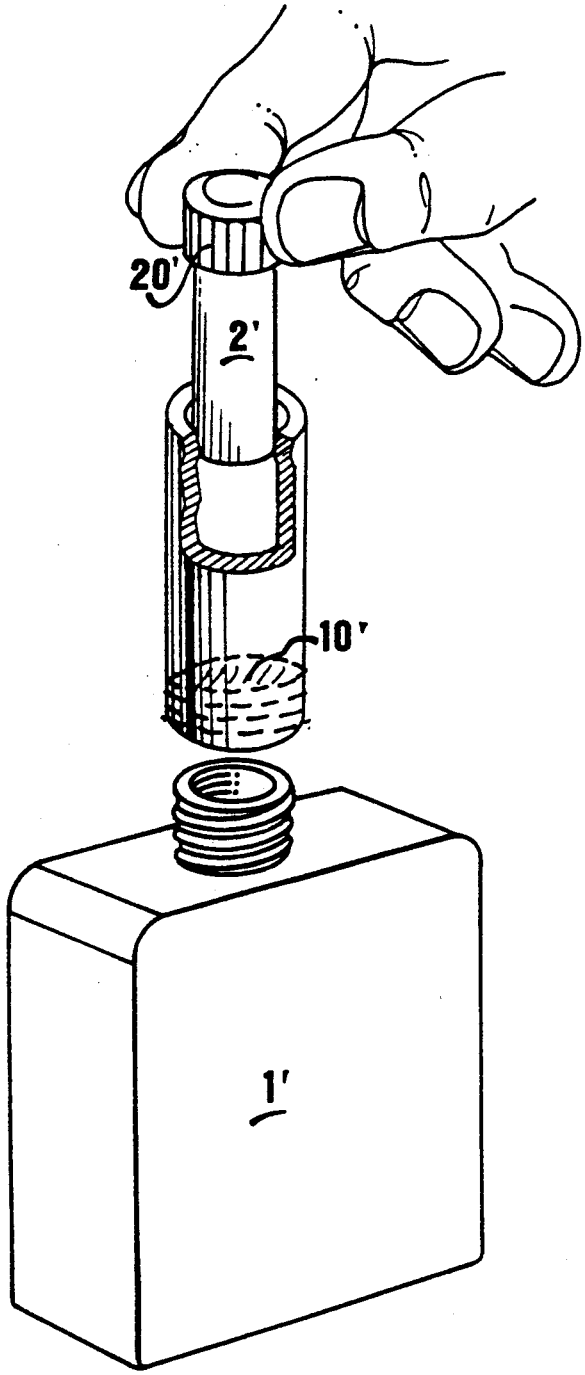
FIG. 3 is an exploded view of an alternative embodiment of the present invention wherein the smaller container is coaxially insertable into the cap of the larger container.
Figure 4:
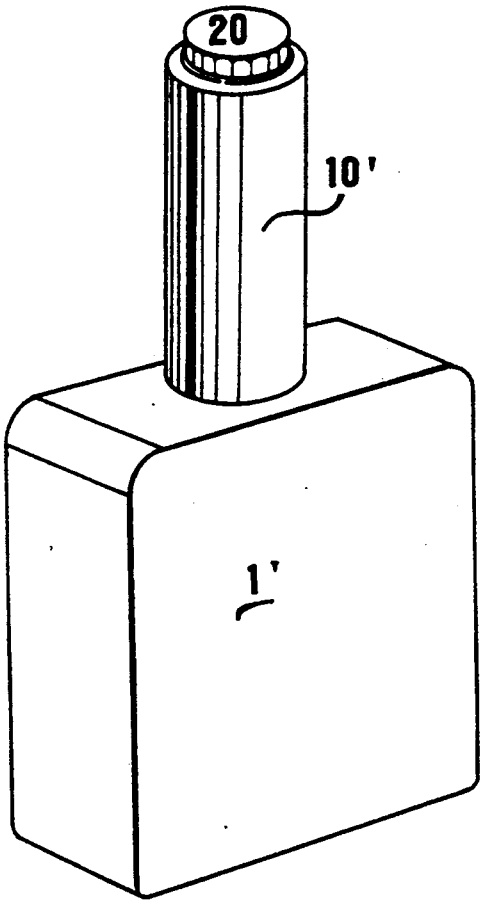
FIG. 4 is a perspective view of the embodiment of FIG. 3 showing the containers is a nesting relationship.

Referring to FIGS. 3 and 4, an alternate embodiment of the present invention comprises the smaller container 2' being of a cylindrical shape. The container 2' is configured such that it fits coaxially within the cap 10' of larger container 1'. The cap 20' of container 2' to be sufficiently above the cap 10' to permit container 2' to be manually withdrawn.

Figure 6:
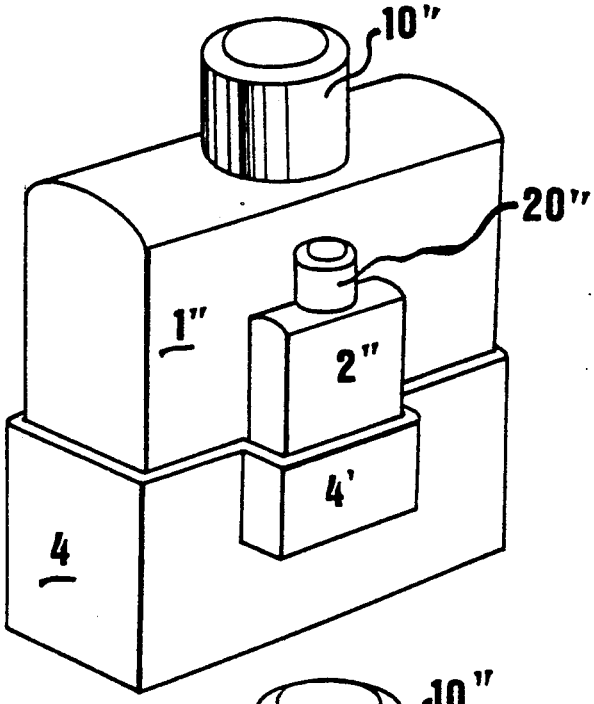
FIG. 6 is a perspective view of the embodiment of FIG. 5 showing the containers in a nesting relationship.
Figure 5:
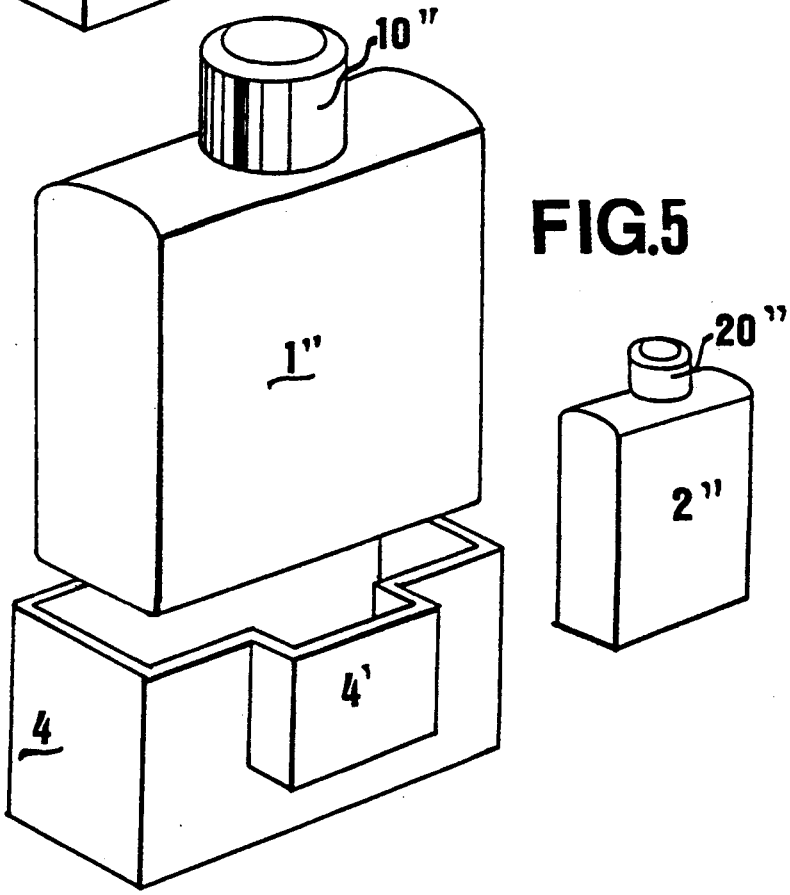
FIG. 5 is an exploded view of a further embodiment of the present invention wherein the smaller container is insertable within a shelf on the larger container.

Referring to FIGS. 5 and 6, a further alternative embodiment of the present invention comprises a smaller container 2" insertable into a shall 4' configured along one face of larger container 1". In contrast to the embodiment of FIGS. 1 and 2, here the smaller container 2" is supported in place along its circumference by the shell 4'.

Having described my invention, many modifications will become apparent to those skilled in the art to which it pertains without deviation from the spirit of the invention as defined by the scope of the appended claims.

I claim:

1. A package container for liquid products, comprising:

a larger container having a top, a bottom and a side wall extending between said top and said bottom;

a smaller container smaller in size than said larger container, said smaller container having a top, a bottom and a side wall extending between said top and said bottom;

a cylindrical cap having means for detachably securing said cylindrical cap to said top of said smaller container so that said cap extends upwardly from said top of said smaller container;

a hollow recess formed in said side wall of said larger container, said recess having spaced sides, a top and a bottom, said recess corresponding in shape and size to said smaller container, said recess further having a semicylindrical portion extending upwardly from said top of said recess;

a deformable portion extending circumferentially around said cap and protruding radially outwardly from said cap, said deformable portion having a diameter greater than a diameter of the semicylindrical portion of said recess so that, upon insertion of said smaller container into said recess and said cap into said semicylindrical portion of said recess, said deformable portion of said cap frictionally engages said semicylindrical portion of said recess thereby forming a self-fastening coupling therebetween thus releasably securing said smaller container in said recess; and finger passages formed adjacent said hollow recess permitting said smaller container to be grasped and forcibly removed from said larger container.

2. A package container for liquid products comprising:

a larger container having a top, a bottom and side walls extending between said top and said bottom:

an externally threaded tubular portion protruding upwardly from said top of said larger container which forms a passageway to an interior of said larger container;

an elongated cap having an upper end and a lower end, said lower end having internal threads which cooperate with the threads of said externally threaded tubular portion protruding upwardly from said top of said larger container to secure said cap to said larger container;

said cap having a cylindrical interior chamber having an open end adjacent to said upper end of said cap and a closed end opposite said open end;

a smaller container, said smaller container being cylindrical in shape with an outside diameter smaller than an inside diameter of said cylindrical interior chamber of said cap so that said smaller container is slidably receivable through said open end into and out of said interior chamber of said cap;

said smaller container having a small container cap, said small container cap including means for securing directly to said smaller container and being dimensioned to protrude above said upper end of said elongated cap when said smaller container is received in said cylindrical interior chamber.

* * * * *

UNITED STATES PATENT AND TRADEMARK OFFICE

CERTIFICATE OF CORRECTION

PATENT NO. : 5,135,116

DATED : August 4, 1992

INVENTOR(S) : Franco Panzetti

It is certified that error appears in the above-identified patent and that said Letters Patent is hereby corrected as shown below:

Column 2, line 26, after 2', delete "to be";

line 31, delete "shall" and insert --shell--

Signed and Sealed this

Twenty-sixth Day of April, 1994

Bruce Lehman

*Attest:*

BRUCE LEHMAN

*Attesting Officer*

*Commissioner of Patents and Trademarks*